US005167524A

United States Patent [19]

Falcon et al.

[11] Patent Number: 5,167,524

[45] Date of Patent: Dec. 1, 1992

[54] COUPLING RESTRAINTS FOR ELECTRICAL CONNECTORS

[76] Inventors: Robert Falcon; Rene Falcon, both of 3725 Antiem St., San Diego, Calif. 92111

[21] Appl. No.: 762,435

[22] Filed: Sep. 19, 1991

[51] Int. Cl.[5] ..... H01R 13/62

[52] U.S. Cl. ..... 439/371; 439/369

[58] Field of Search ..... 439/368, 369, 370, 371

[56] References Cited

U.S. PATENT DOCUMENTS

| | | | |
|---|---|---|---|
| 3,475,716 | 10/1969 | Laig | 439/369 |
| 4,097,105 | 6/1978 | Zumwalt | 439/369 |
| 4,440,465 | 4/1984 | Elliott et al. | 439/369 |
| 4,514,026 | 4/1985 | Herbert | 439/369 |
| 4,596,430 | 6/1986 | Olson | 439/369 |
| 4,690,476 | 9/1987 | Morgenrath | 439/369 |
| 4,907,984 | 3/1990 | Keller | 439/369 |
| 4,917,626 | 4/1990 | Barton | 439/369 |

*Primary Examiner*—Larry I. Schwartz
*Assistant Examiner*—Hien D. Vu
*Attorney, Agent, or Firm*—Dowell & Dowell

[57] ABSTRACT

Releasably mountable coupling restraints for retaining male and female electrical connectors carried by electrical cords in engagement with respect to one another which include a pair of opposing generally U-shaped flexible members which are mounted in surrounding relationship to the electrical cords and in engagement with the male and female connectors and which include integral locking tabs for securing each member relative to its respective connector and wherein self-binding straps are extended between the opposing opposite legs of each member to thereby urge the members toward one another.

6 Claims, 3 Drawing Sheets

COUPLING RESTRAINTS FOR ELECTRICAL CONNECTORS

BACKGROUND OF THE INVENTION

1. Field of the Invention

This invention is generally directed to devices for securing electrical connectors, such as male and female plugs associated with power conductors and power tools and the like, in assembled or united engagement so that electrical power through the plugs is not interrupted by the plugs being accidently separated. More specifically, the present invention is directed to a coupling restraint assembly which includes a pair of generally identically configured U-shaped flexible mounting straps which are secured relative to each of the male and female connectors in opposing relationship with respect to one another using integrally formed locking tabs which are extendable through openings provided in each strap. The mounting straps are constructed so as to be used interchangeably on different types and sizes of power cords and electrical connectors. In a preferred embodiment, a pair of self-binding restraint straps are secured to two legs of one of the generally U-shaped mounting straps and are selectively extendable through openings in opposing leg portions of the adjacent mounting strap. The restraint straps are secured upon themselves by the use of fastening elements of a hook and loop material such as VELCRO.

2. History of the Related Art

Most power tools and heavy duty appliances include a relatively short power cord having a male electrical connector at the end thereof. For all practical purposes, and in particular with power tools such as saws, blowers, hedge trimmers, mowers, drills, and the like, the power cords are only provided as a means by which extension cords can be connected to provide power to the tools. That is, the tools are generally designed for use in an area remote from a power source, such as an electrical socket, and therefore it is almost always necessary that an extension cord be utilized to connect the short power cord associated with the tool or appliance with an electrical socket.

Unfortunately, when utilizing extension cords to connect power equipment to sources of electrical supply, the only locking arrangement provided between the male and female connectors is the friction fit of the prongs of the male connector within the female electrical sockets. Any force exerted along the length of the power cord generally results in the electrical connectors being separated and, in some instances, this can result in very hazardous situations wherein current arcing between the male and female electrical connectors can create sparks or cause damage to the electrical connectors. In some instances, where power tools are designed to be utilized in environments where they are subject to moisture, a loose connection between the power plugs can result in a shorting of electrical energy which can result in electrical shock and potential danger to the individual utilizing the appliance or tool.

To overcome the problems associated with retaining electrical connectors in assembled relationship, there have been many securing devices developed for assuring the mechanical connection of the male and female plugs with the contacts fully seated with respect to one another. Prior to the provision of such supplemental securing devices many individuals simply tied the ends of electrical cords carrying the male and female plugs together and thereafter united the plugs. Such connections are very hazardous and can damage the electrical conductors within the power cords and further do not result in substantially tight and flush seatings of the male connectors within the sockets of the female plugs thus allowing portions of the electrical contacts to be exposed.

Many supplemental coupling adaptors or restraints require modifications to power cords or electrical plugs. By way of example, in U.S. Pat. No. 4,440,465, to Elliott, several embodiments of securing devices are disclosed. In one embodiment, studs are integrally molded with a female connector. A separate strap is mounted to the power cord carrying the male electrical plug with the strap therefrom having a plurality of openings which may be penetrated by the studs of the female connector. Unfortunately, the openings in the strap mounted to the male plug must be spaced relative to one another. Therefore, the only adjustment available is not continuous between the male and female plugs when they are connected and thus, unless the connection is absolutely perfectly aligned between the studs and the openings, the restraints will be generally loosely fitted relative to the electrical connectors. Further, with these types of devices, it is necessary to integrally form the female plug with the required studs. Such a structure is impractical for use with most power tools which are not modified in order to receive a supplemental restraint or securing device.

A similar type of arrangement is disclosed in U.S. Pat. No. 4,514,026 to Herbert, where in one embodiment a plurality of studs are provided on the female plug. However, with this connector there is no separate strap attached directly to the male connector. The strap extends from the female connector and is wrapped around the male connector and thereafter returned to interfit with the studs which are formed on the female connector. Again, the spacing between the openings and the locking studs is not variable and the strength of the assembly will be determined by the degree in which it is possible to wrap the integral strap carried by the female plug relative to the male plug. As with the previous connectors discussed above, this type of connector requires that the female plug be originally molded to include the locking or restraint device, which is impractical.

An arrangement similar to the previous two examples is disclosed in U.S. Pat. No. 4,596,430 to Olson. In this patent, a separate strap member having opposing end portions is wrapped about one of the power cords leading to either the male or female power plug. A pair of studs extend from the outer end portions of the strap member and are selectively engageable within contoured openings which are formed in, or molded in, the sidewalls of the plugs of the mating male or female connector. This device requires that the openings be provided in the opposing power plugs so as to receive the tabs or studs carried at the end of the flexible strap. Such a device either requires that the plugs be integrally formed to incorporate the openings for receiving the studs or that some mechanical change be made to the plugs. Mechanically altering the plug housings by drilling holes in the sides would be extremely dangerous and could potentially lead to situations wherein conductors within the plugs would be exposed by such tampering with the structural integrity of the plugs.

The aforementioned patent to Elliott discloses an alternate embodiment wherein there is no requirement to specifically modify either the male or female plug or connector. In the reference, a pair of U-shaped mounting brackets are designed to be frictionally engaged about the power cord at the base of both the male and female electrical plugs. One of the straps extending from the mounting brackets is provided with outwardly projecting studs while another strap is provided with a series of openings which are spaced equally to the spacing of the studs. Once the straps are placed in opposing relationship, the straps are united to one another by passing the studs through the openings of the opposing strap members. As previously discussed, the effective connection or joint between the male and female plug is dictated by the spacing between the studs and the openings in the flexible strap members. Further, such devices are designed to be utilized only with power cords having a circular cross section and are therefore not appropriately designed for use with power cords having other cross-sectional configurations. Also, because of the friction engagement of each of the base portions of the straps with the power cords, if any stress is placed to separate the straps, the clips on the base portions may be easily removed from the power cords thereby defeating the overall securing nature of the straps.

In the patent to Herbert, another embodiment is shown wherein a single strap is provided having studs at one end and openings at the other. The same alignment problem is found wherein the potential for a loosely fitted engagement of the strap relative to the electrical connectors is possible because of the relative alignment between the studs on one end of the strap and the openings on the other. Further, utilizing a single strap to wrap about opposing connectors does not provide positive locking engagement of the strap and only frictionally binds the connectors together in a configuration which can be overcome if any twisting is developed between the plugs.

Another type of coupling device which requires modification or permanent placement of the coupling members to the opposing plug members is disclosed in U.S. Pat. No. 4,917,626 to Barton. In this patent, the female plug is modified by applying two strips of looped fabric material such as VELCRO which strips are adhesively secured on either side of the female connector. A pair of elongated straps are likewise adhesively secured on opposite sides of the male plug with the straps including hook elements utilized in a VELCRO fastening system. When the male connector is united with the female connector the hooked straps are pulled over opposing looped material and thereafter engaged to retain the connectors in fixed relationship with respect to one another. Such a permanent modification to existing plug elements is generally impractical. It would be preferred to provide securing devices which may be utilized interchangeably between various types of power cords and extension cords without requiring permanent attachment of the coupling elements to such power cords or connectors. In addition, the strength established by simply mating a hook and loop material as taught by the reference would not be sufficient to overcome any significant amount of stress placed along the power cords.

Another type of securing device for power plugs is disclosed in U.S. Pat. No. 4,690,476 to Morgenrath. This patent discloses connecting devices which incorporate VELCRO fasteners in a manner which increases the strength and holding capacity of the engaging loop and hook fabric material. The securing device includes a pair of opposing strap members which are secured about electrical conductors by utilizing a pair of wire ties which attach the end portion of the straps at the base of each of the male and female plugs. One of the straps includes VELCRO materials which are spaced relative to one another while the other of the straps includes ring openings through which the VELCRO members of the opposing strap may be selectively inserted. Once inserted through the opposing straps the VELCRO fasteners are folded over on themselves thereby providing a locking arrangement which is generally continuously adjustable to insure a tight engagement of the power plugs with respect to one another. As the VELCRO material is folded through the loops a great deal of the stress which would be imparted between the two opposing straps is offset by the straps themselves and transmitted to the power cord prior to the hook and loop fastening materials having to counter such stress. Therefore, a distinctive advantage in holding capacity is achieved over structures such as that disclosed in U.S. Pat. No. 4,917,626 to Barton.

Unfortunately, the securing devices disclosed in the reference to Morgenrath require that the base of the unit to be tied to cylindrical power cords and secured thereto utilizing separate wire ties. This assembly is therefore somewhat complex and the wire ties are not easily removable to permit the strap members to be changed or moved from one power cord to another without difficulty. Further, the opposing strap members are separately constructed and therefore each joint must require that the proper strap members be available to create the joint.

SUMMARY OF THE INVENTION

This invention is generally directed to a coupling restraint for securely retaining plugs carried by electrical power cords in electrically seated contact with respect to one another wherein the restraint includes a pair of identically shaped flexible mounting strap members each of which carries an integral locking tab which is selectively insertable through an opening formed in the base of each member so that the members may be selectively secured about any shape of power cord or cable by inserting the integral tab through the opening. Likewise, each mounting strap may be easily removed from a power cord by urging the connecting elements outwardly of the openings at the base of each member so that each mounting strap may be interchangeably used.

The mounting straps are generally U-shaped having leg portions with slots adjacent the ends of each through which separate tightening straps may be selectively extended and thereafter locked upon themselves utilizing fabric fasteners such as hook and loop fasteners of the VELCRO type. In some embodiments, if desired, the tightening straps may be secured to one of the mounting strap members and selectively inserted through the openings in the leg portions of the opposing mounting strap member. In other embodiments, one tightening strap member may be formed on each mounting strap so that the U-shaped straps can be used interchangeably. Further, a shoulder or flange which forms the end of the U-shaped body portion of each mounting strap is provided with a wall which is selectively engagable against a rear portion of each male and female connector and thereby provides an abutment surface for securely engaging and forcing each plug element against one another.

It is a primary object of the present invention to provide coupling restraints for electrical power cords and plug elements which permits a completely adjustable clamping effect to be achieved to retain male and female electrical connectors together once they have been seated with respect to one another.

It is also an object of the present invention to provide coupling restraints which may be used interchangeably and which are easily mounted and removed from power cords and extension cords so that the coupling restraints may be selectively utilized in any environment.

It is yet a further object of the present invention to provide coupling restraints which require no modifications to power plugs or power cords and wherein opposing strap members are identically formed so that they may be used interchangeably thereby reducing the cost of the restraint elements.

It is also an object of the present invention to provide coupling restraint assemblies for use in retaining power plugs in contact with one another wherein flexible straps may be formed of a molded plastic material to include integrally formed locking means for securing the restraints relative to the power plugs in such a manner that they cannot be shifted with respect thereto when tension is applied between male and female connectors of power cords.

DESCRIPTION OF THE PREFERRED EMBODIMENT

Figure 1:
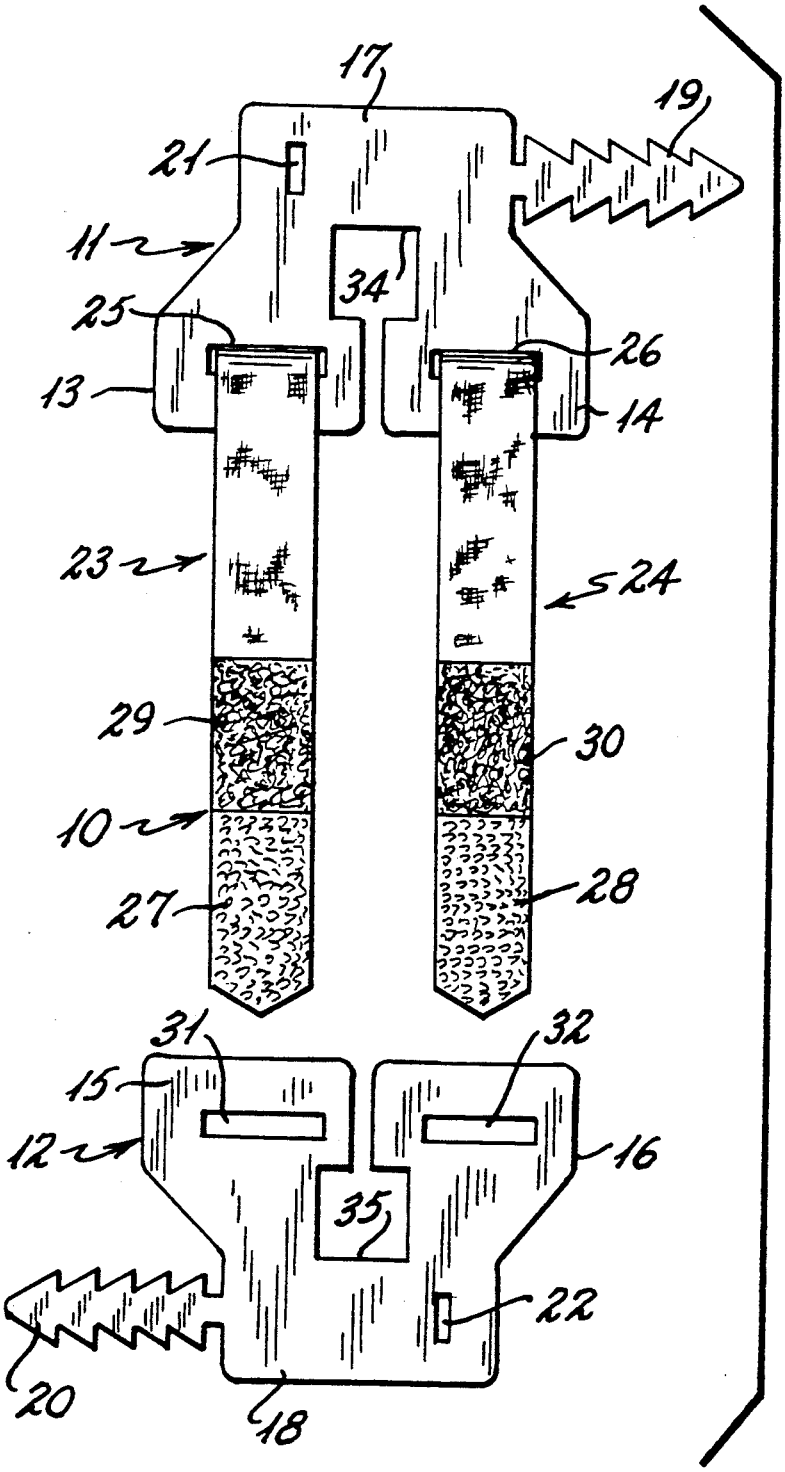
FIG. 1 is an assembly view showing the opposing mounting strap members of the present invention with a pair of connecting straps being selectively connected to the legs of one of the members and positioned so as to be selectively insertable through the openings in the leg portions of the opposing mounting strap member.
Figure 2:
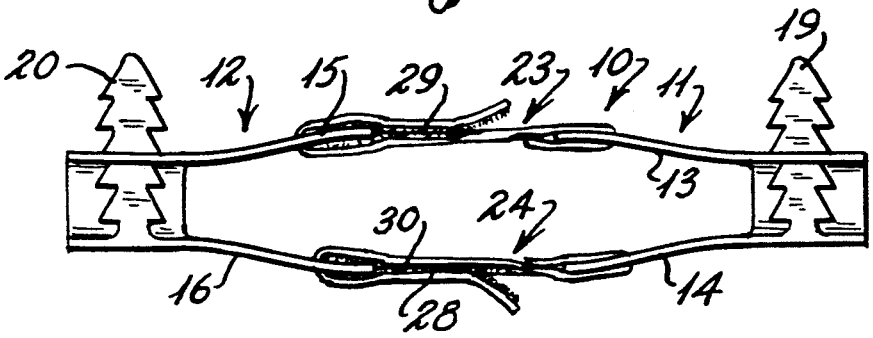
FIG. 2 is a top plan view of the connector shown in FIG. 1 wherein the restraint devices have been shown as being inserted through the openings at the base of each mounting strap member and with the opposing connecting straps uniting the mounting strap members in assembled relationship.
Figure 3:
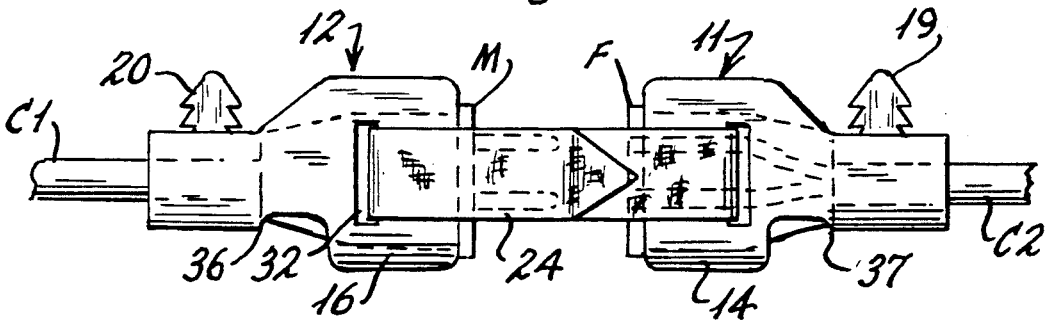
FIG. 3 is a side elevational view of the mounting strap members shown at FIG. 1 wherein the power cords and male and female connectors are also shown.
Figure 4:
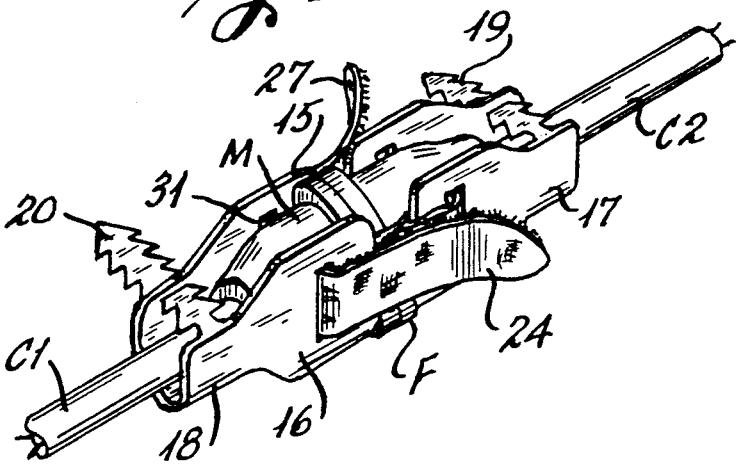
FIG. 4 is a perspective illustrational view of the coupling restraint assembly of the present invention showing the device utilized to secure a male and female connector in fully seated electrical contact with respect to one another.

With continued reference to the drawings, the coupling restraints 10 of the present invention are specifically configured to allow the selective retention or locking of electrical connections made between conventional male M and female F electrical plugs and sockets which are disposed at the end of power cords or conductors C1 and C2, respectively. The coupling restraints include a pair of opposing generally U-shaped body or mounting strap members 11 and 12 each having generally parallel leg portions 13 and 14, and 15 and 16, respectively. Each body member also includes a base portion 17 and 18 having an integral locking tab 19 and 20 extending therefrom. The locking tabs are designed to be selectively inserted into openings 21 and 22 formed in the opposite portion of each of the base members 17 and 18. The body strap members 11 and 12 are preferably formed of a flexible plastic material so that the leg portions 13 and 14, and 15 and 16, may be folded over relative to one another to thereby configure the base portions 17 and 18 into a generally U-shape to envelop the power cords C1 and C2 therebetween, as shown in FIGS. 3 and 4. In this respect, due to the flexibility of the body members 11 and 12, they may be utilized to envelop not only power conductors having circular cross-sectional configurations of various dimensions, but may also be utilized on rectangular or flat power cables or cords. When the body members 11 and 12 are wrapped about the power cords C1 and C2, as shown in FIGS. 3 and 4, and the locking tabs 19 and 20 inserted through respective openings 21 and 22 of the base portions thereof, the units may be secured tightly about the cords in such a manner that the opposing leg portions 13 and 14, and 15 and 16, are brought into engagement with opposing sides of the male plug M and female socket F, as shown.

Figure 5:
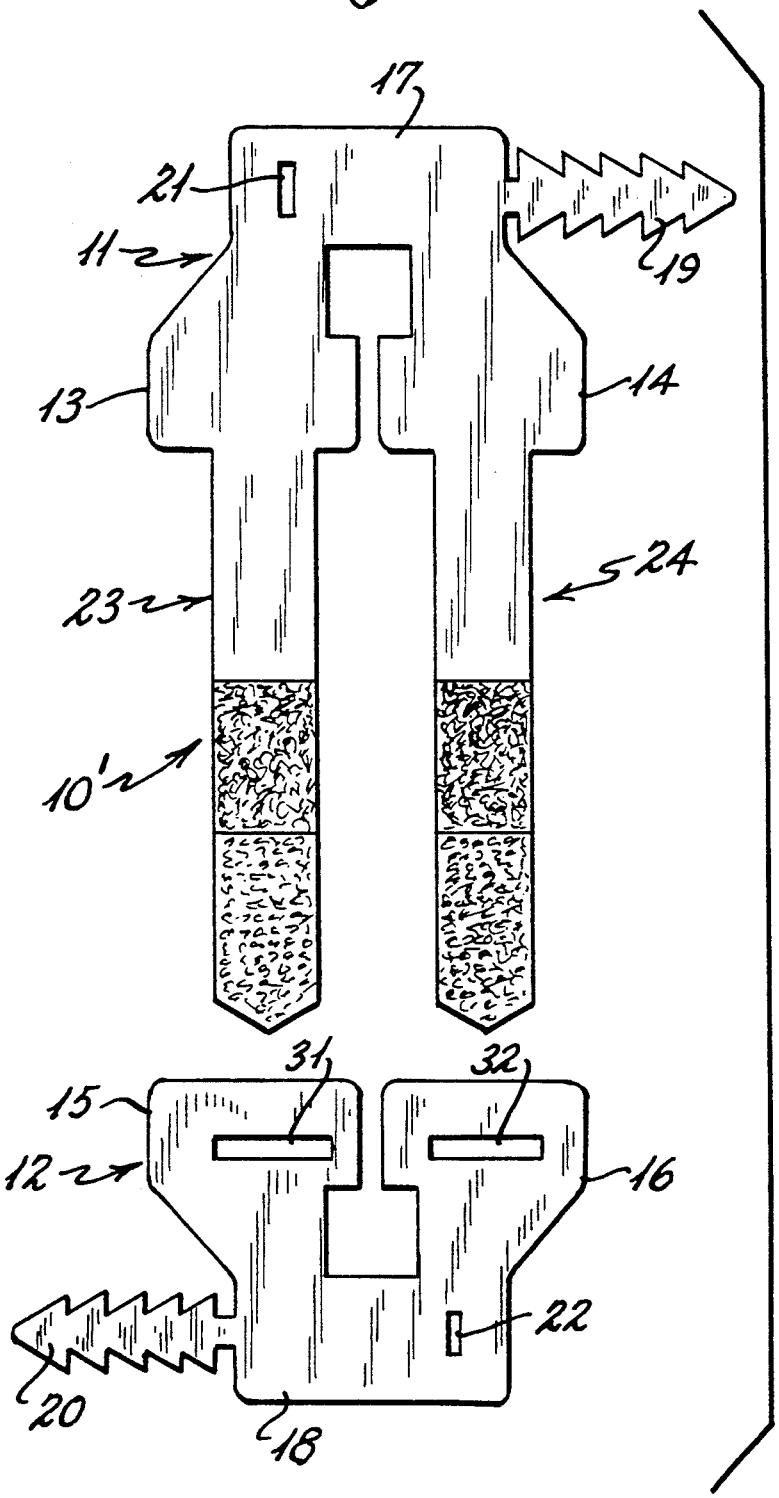
FIG. 5 is an assembly view of another embodiment of the present invention.

To draw the two body members 11 and 12 into locked or fixed relationship with respect to one another, a pair of flexible connecting straps 23 and 24 are inserted through and secured relative to body member 11 by passing through a pair of slots 25 and 26 provided in the outer portion of the leg elements 13 and 14. It is generally preferred that the straps 23 and 24 be permanently secured through the slots 25 and 26, however selective attachment by way of hook and loop fasteners and other conventional fastening elements may be utilized to connect the ends of the straps upon themselves. In some embodiments, as shown in FIG. 5 at 10', the slots 25 and 26 may be omitted and the straps integrally formed with, or secured directly to, the leg elements 13 and 14. The reference characters in FIG. 5 correspond to the same elements identified in FIGS. 1–4. It should be noted that in the embodiment shown in FIGS. 1–4, the straps 23 and 24 may be secured to either of the body members 11 or 12 as the body members are identically configured with respect to one another. Also, in some embodiments, one connecting strap may be fixed to one leg of one of the body members 11 and 12 while a second connecting strap is fixed to the other body member.

The outer portion of the straps 23 and 24 have hooked VELCRO materials 27 and 28 adhesively or otherwise secured thereto with the outer ends being tipped or pointed as shown in the drawing figures. Adjacent to the hooked fabric material are strips of looped fabric materials 29 and 30 of a VELCRO type which are designed to interengage with the hook material 27 and 28 after the ends of the straps are inserted through openings 31 and 32 provided through the opposing leg portions 15 and 16 of the body member 12. After the straps 23 and 24 are inserted through the slots 31 and 32 in the body member 12 a selective adjustment may be made by pulling on the end portions 27 and 28 of the straps and then folding the end portions over the looped fabric materials 29 and 30 thereby locking the straps 23 and 24 relative to the body member 12. To separate the two body members 11 and 12 it is only necessary to lift up on the hooked end portions 27 and 28 and lift them from their selective engagement with the looped portions 29 and 30, thereafter withdrawing the straps 23 and 24 from the slots 31 and 32.

In view of the foregoing, it is preferred that the connecting straps 23 and 24 be formed of a flexible fabric or canvas-like material having the VELCRO or similar fabric fastening elements sewn, adhesively secured or sonicly welded thereto. After the straps have been secured upon themselves to retain body members 11 and 12 of the coupling restraints in assembled relationship such as shown in FIG. 4, any stress which is placed upon the power cords C1 and C2 which would normally tend to separate the plugs M and F from one another is effectively prevented. Further, it should be noted that each of the base portions of body members 11 and 12 includes an inner wall 34 and 35 which are provided for abutting the rear of the plug member M and socket F, as is shown particularly at 36 and 37 in drawing FIG. 3. In this manner, the body members 11 and 12 cannot be pulled over and around the plug M and socket F during the use of the coupling restraint.

In the use of the coupling restraint of the present invention, the body member 12 is initially folded about the power cord C1 with the locking tab 20 being inserted through the opening 22 in the base portion 18 thereof and is then pulled tight so as to fold the leg portions 15 and 16 so that they extend on either side of the plug M. The abutment wall 35 is positioned so as to engage the rear portion of the plug M as shown at 36. Thereafter, the member 11 is wrapped about power cord C2 with the tab portion 19 being inserted through the opening 21 and is thereafter drawn into tight engagement with the power cord so that the abutment wall 37 of the member engages the rear portion of the socket F. The plug M and socket F are thereafter electrically connected to one another. The connecting straps 23 and 24 are subsequently inserted through the slots 31 and 32 of the member 12 and are folded back upon themselves and pulled tight. Once the straps have been pulled tight they are pressed upon themselves so as to engage the hook and loop materials 27 and 29, and 28 and 30, to retain the restraint device in locked position.

We claim:

1. A releasably mounted coupling restraint for retaining a male electrical plug and female electrical socket carried by opposing electrical cords in electrical contact with one another comprising, first and second flexible and opposing generally U-shaped body members, each of said body members having spaced generally parallel leg portions interconnected by a base portion, said base portions having an inner wall and outer side edges, said inner wall extending between said leg portions and forming an abutment surface for engaging one of the male electrical plug and female electrical socket immediately adjacent the electrical cords, a locking tab means extending outwardly from one of said side edges of each base portion and an opening through said base portions adjacent the other edges thereof, said openings being of a size and configuration to selectively and lockingly receive said tab portions therethrough when said base portions are folded, a pair of connecting strap means extending outwardly from said leg portions of one of said body members toward the leg portions of the opposing body member, each of said connecting strap means having outer end and intermediate portions, a slot in each of said leg portions of said opposing body member through which said connecting strap means are selectively received, and fastening means for uniting the outer end portions of said connecting strap means to said intermediate portions thereof after being inserted through said slots to thereby retain said body members in assembled relationship with respect to one another.

2. The releasably mounted coupling restraint of claim 1 in which said fastening means includes interengageable hook and loop material, one of said hook and loop material being secured to said outer end portions of said connecting strap means and the other of said hook and loop material being secured to said intermediate portions of said connecting strap means.

3. The releasably mounted coupling restraint of claim 1 in which said first and second generally U-shaped body members are identically structured so as to be interchangeably used to restrain the male electrical plug and female electrical socket in coupled relationship with respect to one another.

4. A releasably mounted coupling restraint for retaining a male electrical plug and female electrical socket carried by opposing electrical cords in electrical contact with one another comprising, first and second flexible and opposing generally U-shaped body members, each of said body members having spaced generally parallel leg portions interconnected by a base portion, said base portions having an inner wall and outer side edges, said inner wall extending between said leg portions and forming an abutment surface for engaging one of the male electrical plug and female electrical socket immediately adjacent the electrical cords, a locking tab means extending outwardly from one of said side edges of each base portion and an opening through said base portions adjacent the other edges thereof, said openings being of a size and configuration to selectively and lockingly receive said tab portions therethrough when said base portions are folded, a pair of connecting strap means extending between said leg portions of said body members, each of said connecting strap means having outer end and intermediate portions, a slot in at least one of said leg portions of said opposing body member through which said connecting strap means are selectively received, and fastening means for uniting the outer end portions of said connecting strap means to said intermediate portions thereof after being inserted through said slots to thereby retain said body members in assembled relationship with respect to one another.

5. The releasably mounted coupling restraint of claim 4 in which said fastening means includes interengageable hook and loop material, one of said hook and loop material being secured to said outer end portions of said connecting strap means and the other of said hook and loop material being secured to said intermediate portions of said connecting strap means.

6. The releasably mounted coupling restraint of claim 4 in which said first and second generally U-shaped body members are identically structured so as to be interchangeably used to restrain the male electrical plug and female electrical socket in coupled relationship with respect to one another.

* * * * *